US008791770B2

(12) United States Patent
Mori

(10) Patent No.: US 8,791,770 B2
(45) Date of Patent: Jul. 29, 2014

(54) DIRECTIONAL COUPLER

(71) Applicant: Murata Manufacturing Co., Ltd., Nagaokakyo (JP)

(72) Inventor: Takahiro Mori, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/721,134

(22) Filed: Dec. 20, 2012

(65) Prior Publication Data

US 2013/0120076 A1 May 16, 2013

Related U.S. Application Data

(63) Continuation of application No. PCT/JP2011/059268, filed on Apr. 14, 2011.

(30) Foreign Application Priority Data

Jul. 6, 2010 (JP) ..... 2010-153993

(51) Int. Cl.
*H01P 5/12* (2006.01)
*H01P 3/08* (2006.01)

(52) U.S. Cl.
USPC ..... 333/116; 333/109

(58) Field of Classification Search
USPC ..... 333/109, 110, 111, 112, 116
See application file for complete search history.

(56) References Cited

U.S. PATENT DOCUMENTS

| | | | | |
|---|---|---|---|---|
| 5,359,304 | A | 10/1994 | Fujiki | |
| 5,369,379 | A * | 11/1994 | Fujiki | 333/116 |
| 5,557,245 | A | 9/1996 | Taketa et al. | |
| 5,841,328 | A * | 11/1998 | Hayashi | 333/116 |
| 6,686,812 | B2 * | 2/2004 | Gilbert et al. | 333/112 |
| 7,567,147 | B2 * | 7/2009 | Toujo et al. | 333/116 |
| 8,044,749 | B1 * | 10/2011 | Witas et al. | 333/116 |
| 8,629,735 | B2 * | 1/2014 | Mori et al. | 333/109 |
| 2005/0062557 | A1 | 3/2005 | Kang et al. | |
| 2010/0109829 | A1 | 5/2010 | Sugiyama et al. | |

FOREIGN PATENT DOCUMENTS

| | | | |
|---|---|---|---|
| CN | 101728055 | A | 6/2010 |
| JP | 05-152814 | A | 6/1993 |
| JP | 2817487 | B2 | 6/1993 |
| JP | 07-131211 | A | 5/1995 |
| JP | 3097569 | B2 | 10/2000 |
| JP | 2006-191221 | A | 7/2006 |
| JP | 2010-011519 | A | 1/2010 |

OTHER PUBLICATIONS

Official Communication issued in International Patent Application No. PCT/JP2011/059268, mailed on Jul. 5, 2011.

* cited by examiner

*Primary Examiner* — Dean O Takaoka
(74) *Attorney, Agent, or Firm* — Keating and Bennett, LLP

(57) ABSTRACT

In a directional coupler, a laminated body includes a plurality of insulator layers that are laminated to one another. A main line and a sub-line are embedded in the laminated body, include spiral-shaped portions including central axes parallel or substantially parallel to a z-axis direction, and are electromagnetically coupled to each other. The main line and the sub-line have the same or substantially the same shape and are provided within regions coinciding or substantially coinciding with each other in a y-axis direction.

17 Claims, 10 Drawing Sheets

DIRECTIONAL COUPLER

BACKGROUND OF THE INVENTION

1. Field of the Invention

The present invention relates to a directional coupler, and more specifically, to a directional coupler including a spiral-shaped main line and a spiral-shaped sub-line that are embedded in a laminated body.

2. Description of the Related Art

As a directional coupler of the related art, for example, a laminated type directional coupler described in Japanese Unexamined Patent Application Publication No. 2010-11519 is known. Hereinafter, the laminated type directional coupler described in Japanese Unexamined Patent Application Publication No. 2010-11519 will be described. FIG. 11 is the exploded view of a laminated type directional coupler 500 described in Japanese Unexamined Patent Application Publication No. 2010-11519.

As illustrated in FIG. 11, the laminated type directional coupler 500 includes dielectric sheets 502*a* to 502*g*, a main line 504, and a sub-line 506. The main line 504 includes a vortex-shaped first coupling line portion 504*a* and a vortex-shaped second coupling line portion 504*b* that are connected to one another. The first coupling line portion 504*a* and the second coupling line portion 504*b* are provided on dielectric sheets 502*b* and 502*e*, respectively. On the other hand, the sub-line 506 includes a vortex-shaped first coupling line portion 506*a* and a vortex-shaped second coupling line portion 506*b* that are connected to one another. The first coupling line portion 506*a* and the second coupling line portion 506*b* are provided on dielectric sheets 502*c* and 502*f*, respectively. In addition, the first coupling line portion 504*a* and the first coupling line portion 506*a* are electromagnetically coupled to one another, and the second coupling line portion 504*b* and the second coupling line portion 506*b* are electromagnetically coupled to one another. The laminated type directional coupler 500 configured in such a manner as described above is mounted on a circuit substrate so that a surface on a lower side in a lamination direction defines a mounting surface.

In the laminated type directional coupler 500 described in Japanese Unexamined Patent Application Publication No. 2010-11519, it is necessary to discriminate the direction of the laminated type directional coupler 500 at the time of being mounted to the circuit substrate. In more detail, the laminated type directional coupler 500 can be mounted so that the main line 504 defines a main line and the sub-line 506 defines a sub-line, and furthermore, can be mounted to the circuit substrate so that the main line 504 defines a sub-line and the sub-line 506 defines a main line. However, as described below, there is a problem in that the characteristics of the laminated type directional coupler 500 fluctuate.

The main line 504 is provided on an upper side in the lamination direction, as compared to the sub-line 506. In more detail, the first coupling line portion 504*a* is provided on an upper side in the lamination direction, as compared to the first coupling line portion 506*a*, and the second coupling line portion 504*b* is provided on an upper side in the lamination direction, as compared to the second coupling line portion 506*b*. Therefore, stray capacitance occurring between a wiring line or a ground conductor within the circuit substrate and the main line 504 is less than stray capacitance occurring between the wiring line or the ground conductor within the circuit substrate and the sub-line 506. Accordingly, the characteristics of the laminated type directional coupler 500 when the main line 504 defines a sub-line and the sub-line 506 defines a main line are different from those when main line 504 defines a main line and the sub-line 506 defines a sub-line. Therefore, in the laminated type directional coupler 500, it is necessary to discriminate the direction of the laminated type directional coupler 500 at the time of being mounted to the circuit substrate.

Therefore, a direction recognition mark (not illustrated) is provided on the surface (for example, the back surface of a dielectric sheet 502*g*) of the laminated type directional coupler 500 of the related art. By the mounting apparatus recognizing this direction recognition mark, the laminated type directional coupler is mounted on the circuit substrate in a desired direction. However, there is a problem in that the formation of the directional mark complicates the manufacturing process for the laminated type directional coupler. In addition, since it is necessary to mount the laminated type directional coupler to the circuit substrate after the direction thereof has been discriminated, there is also a problem in that the time required for the directional coupler to be mounted to the circuit substrate is increased.

SUMMARY OF THE INVENTION

To overcome the problems described above, preferred embodiments of the present invention provide a directional coupler with which it is not necessary to discriminate the direction thereof at the time of being mounted to a circuit substrate and in which no directional mark is provided.

A directional coupler according to a preferred embodiment of the present invention includes a laminated body including a plurality of insulator layers that are laminated to one another and a mounting surface parallel or substantially parallel to a lamination direction, and a main line and a sub-line embedded in the laminated body and including a first spiral-shaped portion and a second spiral-shaped portion having central axes parallel or substantially parallel to the lamination direction, the main line and the sub-line being electromagnetically coupled to each other, wherein the main line and the sub-line have approximately the same shape and are provided within regions coinciding or substantially coinciding with each other in a direction perpendicular or substantially perpendicular to the mounting surface.

According to various preferred embodiments of the present invention, it is possible to provide a directional coupler with which it is not necessary to discriminate the direction thereof at the time of being mounted to a circuit substrate.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, directional couplers according to preferred embodiments of the present invention will be described.

Figure 1:
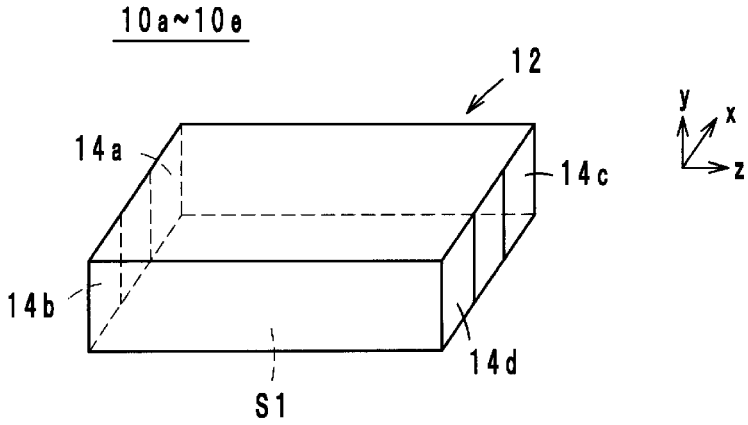
FIG. 1 is a perspective view of a directional coupler according to a preferred embodiment of the present invention.
Figure 2:
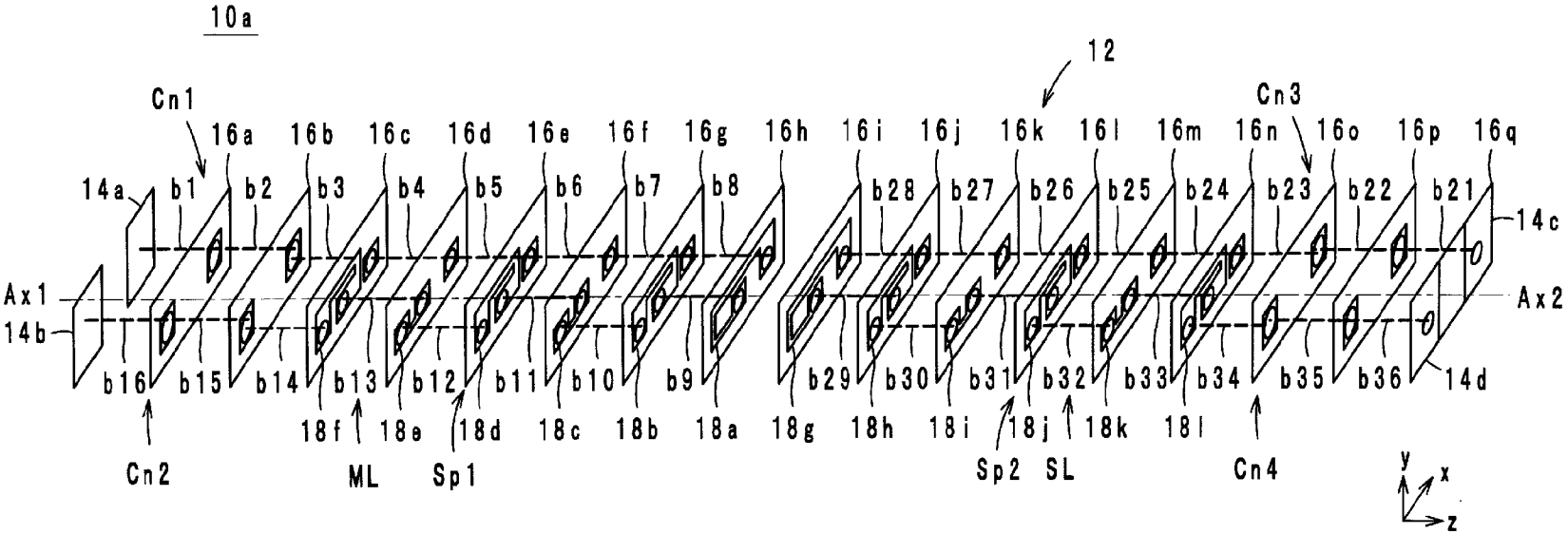
FIG. 2 is an exploded perspective view of a directional coupler according to a first preferred embodiment of the present invention.
Figure 3A:
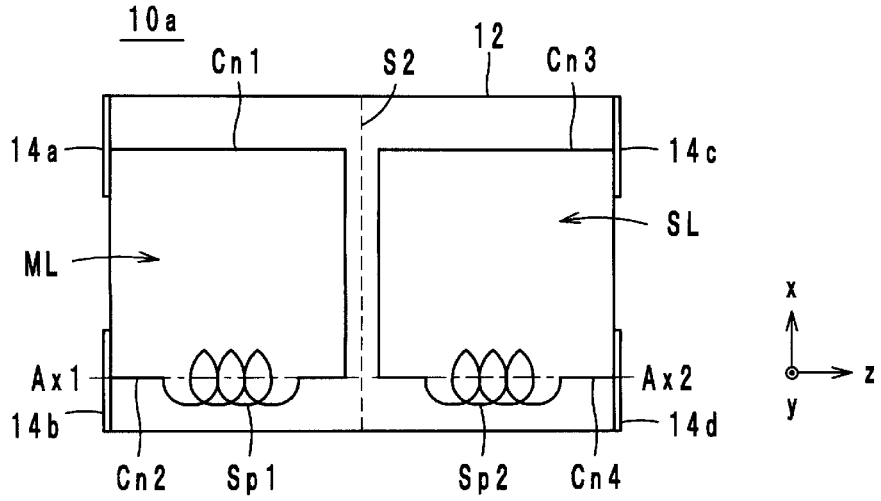
FIGS. 3A and 3B are diagrams schematically illustrating a directional coupler according to the first preferred embodiment of the present invention.
Figure 3B:
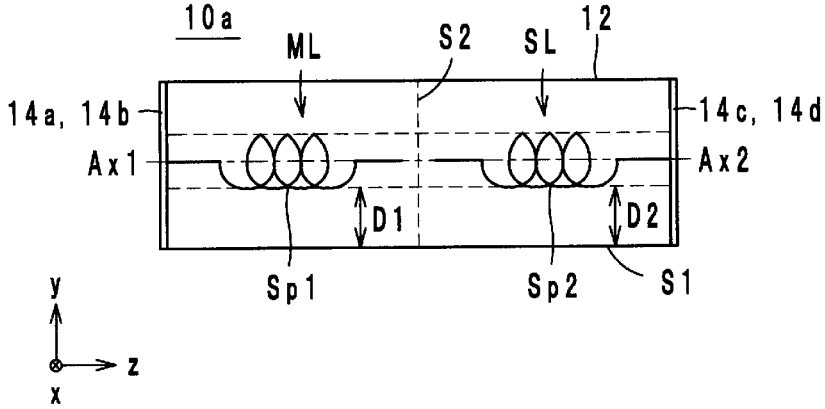

Hereinafter, a directional coupler according to a first preferred embodiment of the present invention will be described with reference to the drawings. FIG. 1 is the perspective view of each of directional couplers 10*a* to 10*e* according to various preferred embodiments of the present invention. FIG. 2 is the exploded perspective view of the directional coupler 10*a* according to the first preferred embodiment. FIGS. 3A and 3B are diagrams schematically illustrating the directional coupler 10*a* according to the first preferred embodiment. Hereinafter, the lamination direction of the directional coupler 10*a* is defined as a z-axis direction, and in planar view from the z-axis direction, a direction along the long side of the directional coupler 10*a* is defined as an x-axis direction and a direction along the short side of the directional coupler 10*a* is defined as a y-axis direction. The x-axis, y-axis, and z-axis are perpendicular to one another.

As illustrated in FIG. 1 and FIG. 2, the directional coupler 10*a* includes a laminated body 12, external electrodes 14 (14*a* to 14*d*), a main line ML, and a sub-line SL.

As illustrated in FIG. 1, the laminated body 12 preferably has a rectangular or substantially rectangular parallelepiped shape, and includes the main line ML and the sub-line SL disposed therein. The laminated body 12 includes a mounting surface S1 parallel or substantially parallel to the z-axis direction. In more detail, the mounting surface S1 is a bottom surface on a negative direction side in the y-axis direction of the laminated body 12. As illustrated in FIG. 2, with the insulator layers 16 (16*a* to 16*q*) being laminated so as to be arranged from a negative direction side to a positive direction side in the z-axis direction in this order, the laminated body 12 is configured. Each of the insulator layers 16 preferably has a rectangular or substantially rectangular shape, and is made of a dielectric material. Hereinafter, a surface on a positive direction side in the z-axis direction of the insulator layer 16 is referred to as a surface, and a surface on a negative direction side in the z-axis direction of the insulator layer 16 is referred to as a back surface.

As illustrated in FIG. 2, each of the external electrodes 14*a* and 14*b* is provided in a side surface on a negative direction side in the z-axis direction of the laminated body 12. In other words, each of the external electrodes 14*a* and 14*b* is provided in the back surface of the insulator layer 16*a*. In addition, the external electrode 14*a* is located on a positive direction side in the x-axis direction, as compared to the external electrode 14*b*. The external electrodes 14*a* and 14*b* preferably are only provided in a side surface on a negative direction side in the z-axis direction of the laminated body 12, and not provided in the other surfaces of the laminated body 12.

In addition, as illustrated in FIG. 2, each of the external electrodes 14*c* and 14*d* is provided in a side surface on a positive direction side in the z-axis direction of the laminated body 12. In other words, each of the external electrodes 14*a* and 14*b* is provided in the surface of the insulator layer 16*q*. In addition, the external electrode 14*c* is located on a positive direction side in the x-axis direction, as compared to the external electrode 14*d*. The external electrodes 14*c* and 14*d* are only provided in a side surface on a positive direction side in the z-axis direction of the laminated body 12, and not provided in the other surfaces of the laminated body 12.

Such external electrodes 14*a* and 14*b* and external electrodes 14*c* and 14*d* as described above are preferably plane-symmetrical or substantially plane-symmetrical with respect to a surface S2 (a surface located midway between the surface and back surface of the insulator layer 16*i* (refer to FIGS. 3A and 3B)) located midway between side surfaces located in both ends in the z-axis direction of the laminated body 12.

The main line ML is connected between the external electrodes 14*a* and 14*b*, and as illustrated in FIG. 2, includes a spiral-shaped portion Sp1 and connection portions Cn1 and Cn2. The spiral-shaped portion Sp1 is a signal line having a spiral shape extending from the positive direction side to the negative direction side in the z-axis direction while winding in a counterclockwise direction in planar view from the positive direction side in the z-axis direction. In other words, the spiral-shaped portion Sp1 has a central axis Ax1 parallel or substantially parallel to the z-axis direction. The spiral-shaped portion Sp1 is defined by signal conductors 18*a* to 18*f* and via hole conductors b9 to b13.

Each of the signal conductors 18*a* to 18*f* preferably includes a conductive material, and is defined by a linear conductor that is folded. Hereinafter, in planar view from the positive direction side in the z-axis direction, an end portion on an upstream side in the counterclockwise direction of the signal conductor 18 is referred to as an upstream end, and an end portion on an downstream side in the counterclockwise direction of the signal conductor 18 is referred to as a downstream end.

The via hole conductors b9 to b13 penetrate the insulator layers 16*h*, 16*g*, 16*f*, 16*e*, and 16*d*, respectively, in the z-axis direction, and connect the signal conductors 18. In more detail, the via hole conductor b9 connects the downstream end of the signal conductor 18*a* and the upstream end of the signal conductor 18*b*. The via hole conductor b10 connects the downstream end of the signal conductor 18*b* and the upstream end of the signal conductor 18*c*. The via hole conductor b11 connects the downstream end of the signal conductor 18*c* and the upstream end of the signal conductor 18*d*. The via hole conductor b12 connects the downstream end of the signal conductor 18*d* and the upstream end of the signal conductor 18*e*. The via hole conductor b13 connects the downstream end of the signal conductor 18*e* and the upstream end of the signal conductor 18*f*.

As illustrated in FIG. 2, the connection portion Cn1 connects an end portion (namely, the upstream end of the signal conductor 18*a*) on a positive direction side in the z-axis direction of the spiral-shaped portion Sp1 and the external electrode 14*a*, and is defined by via hole conductors b1 to b8. The via hole conductors b1 to b8 penetrate the insulator layers 16*a* to 16*h*, respectively, in the z-axis direction, and by being connected to each other, define one via hole conductor.

As illustrated in FIG. 2, the connection portion Cn2 connects an end portion (namely, the downstream end of the signal conductor 18*f*) on a negative direction side in the z-axis direction of the spiral-shaped portion Sp1 and the external electrode 14*b*, and is defined by via hole conductors b14 to b16. The via hole conductors b14 to b16 penetrate the insulator layers 16*c*, 16*b*, and 16*a*, respectively, in the z-axis direction, and by being connected to each other, define one via hole conductor. As described above, as illustrated in FIG. 3A, the main line ML is connected between the external electrodes 14*a* and 14*b*.

The sub-line SL is connected between the external electrodes 14*c* and 14*d*, and defines a directional coupler by being electromagnetically coupled to the main line ML. As illustrated in FIG. 2, the sub-line SL includes a spiral-shaped portion Sp2 and connection portions Cn3 and Cn4.

The spiral-shaped portion Sp2 is a signal line having a spiral shape extending from the negative direction side to the positive direction side in the z-axis direction while winding in a clockwise fashion in planar view from the positive direction side in the z-axis direction. In other words, the spiral-shaped portion Sp2 has a central axis Ax2 parallel or substantially parallel to the z-axis direction. As illustrated in FIGS. 3A and 3B, the central axis Ax2 coincides or substantially coincides with the central axis Ax1. The spiral-shaped portion Sp2 is defined by signal conductors 18*g* to 18*l* and via hole conductors b29 to b33.

Each of the signal conductors 18*g*, 18*h*, 18*j*, and 18*l* preferably includes a conductive material, and is defined by a linear conductor that is folded. The signal conductors 18*g*, 18*h*, 18*j*, and 18*l* are plane-symmetrical or substantially plane-symmetrical to the signal conductors 18*a*, 18*b*, 18*d*, and 18*f*, respectively, with respect to the surface S2. Each of the signal conductors 18*i* and 18*k* preferably includes a conductive material, and is defined by a linear conductor that is folded. The signal conductors 18*i* and 18*k* are plane-symmetrical or substantially plane-symmetrical to the signal conductors 18*c* and 18*e*, respectively, with respect to the surface S2. Hereinafter, in planar view from the positive direction side in the z-axis direction, an end portion on an upstream side in the clockwise direction of the signal conductor 18 is referred to as an upstream end and an end portion on a downstream side in the clockwise direction of the signal conductor 18 is referred to as a downstream end.

The via hole conductors b29 to b33 penetrate the insulator layers 16*i* to 16*m*, respectively, in the z-axis direction, and connect the signal conductors 18. In more detail, the via hole conductor b29 connects the upstream end of the signal conductor 18*g* and the downstream end of the signal conductor 18*h*. The via hole conductor b30 connects the upstream end of the signal conductor 18*h* and the downstream end of the signal conductor 18*i*. The via hole conductor b31 connects the upstream end of the signal conductor 18*i* and the downstream end of the signal conductor 18*j*. The via hole conductor b32 connects the upstream end of the signal conductor 18*j* and the downstream end of the signal conductor 18*k*. The via hole conductor b33 connects the upstream end of the signal conductor 18*k* and the downstream end of the signal conductor 18*l*.

The connection portion Cn3 is plane-symmetrical or substantially plane-symmetrical to the connection portion Cn1 with respect to the surface S2. As illustrated in FIG. 2, the connection portion Cn3 connects an end portion (namely, the downstream end of the signal conductor 18*g*) on a negative direction side in the z-axis direction of the spiral-shaped portion Sp2 and the external electrode 14*c*, and is defined by via hole conductors b21 to b28. The via hole conductors b21 to b28 penetrate the insulator layers 16*q*, 16*p*, 16*o*, 16*n*, 16*m*, 16*l*, 16*k*, and 16*j*, respectively, in the z-axis direction, and by being connected to each other, define one via hole conductor.

The connection portion Cn4 is plane-symmetrical or substantially plane-symmetrical to the connection portion Cn2 with respect to the surface S2. As illustrated in FIG. 2, the connection portion Cn4 connects an end portion (namely, the upstream end of the signal conductor 18*l*) on a positive direction side in the z-axis direction of the spiral-shaped portion Sp2 and the external electrode 14*d*, and is defined by via hole conductors b34 to b36. The via hole conductors b34 to b36 penetrate the insulator layers 16*o* to 16*q*, respectively, in the z-axis direction, and by being connected to each other, configure one via hole conductor. As described above, as illustrated in FIG. 3A, the sub-line SL is connected between the external electrodes 14*c* and 14*d*.

The main line ML and the sub-line SL, configured in such a manner as described above, have substantially the same shapes, and as illustrated in FIG. 3B, are provided within regions coinciding or substantially coinciding with each other in the perpendicular direction (y-axis direction) of the mounting surface S1. In more detail, the main line ML and the sub-line SL are symmetrical or substantially symmetrical to each other with respect to the surface S2. Therefore, in planar view from the z-axis direction, the main line ML and the sub-line SL overlap with each other so as to coincide or substantially coincide with each other. Accordingly, as illustrated in FIG. 3B, the main line ML and the sub-line SL are disposed within regions coinciding or substantially coinciding with each other in the y-axis direction. As a result, a distance D1 between the main line ML and the mounting surface S1 and a distance D2 between the sub-line SL and the mounting surface S1 are equal or substantially equal to each other.

In the directional coupler 10*a* configured in such a manner as described above, when the main line ML is used as a main line and the sub-line SL is used as a sub-line, the external electrode 14*a* is used as an input port, the external electrode 14*b* is used as a main output port, the external electrode 14*c* is used as a monitor output port, and the external electrode 14*d* is used as a 50Ω terminating port. On the other hand, when the main line ML is used as a sub-line and the sub-line SL is used as a main line, the external electrode 14*d* is used as an input port, the external electrode 14*c* is used as a main output port, the external electrode 14*b* is used as a monitor output port, and the external electrode 14*a* is used as a 50Ω terminating port, for example.

Next, a non-limiting example of a manufacturing method for the directional coupler 10*a* will be described with reference to FIG. 1 and FIG. 2.

First, ceramic green sheets to be the insulator layers 16 are prepared. Next, the via hole conductors b1 to b16 and b21 to b36 are formed in the individual ceramic green sheets to be the insulator layers 16. Specifically, the ceramic green sheets to be the insulator layers 16 are subjected to a laser beam, and via holes are formed. Next, the via holes are filled with a conductive paste preferably including Ag, Pd, Cu, Au, or an alloy thereof, for example, by a method, such as printing.

Next, by applying a conductive paste preferably including Ag, Pd, Cu, Au, or an alloy thereof, for example, as a main component to the surfaces of ceramic green sheets to be the insulator layers 16*c* to 16*n* by a method, such as a screen printing method or a photolithographic method, for example, the signal conductors 18 are formed. In addition, at the time of forming the signal conductors 18, the via holes may be filled with the conductive paste.

In addition, by applying a conductive paste preferably including Ag, Pd, Cu, Au, or an alloy thereof, for example, as a main component to the back surface of a ceramic green sheet to be the insulator layer 16*a* and the surface of a ceramic green sheet to be the insulator layer 16*q* by a method, such as the screen printing method or the photolithographic method, for example, the external electrodes 14*a* to 14*d* are formed.

Next, each ceramic green sheet is laminated. Specifically, the ceramic green sheets to be the insulator layer 16*a* to 16*q* are individually laminated and pressure-bonded so as to be arranged from the negative direction side to the positive direction side in the z-axis direction in this order. With the above-described processes, a mother laminated body is formed. Main pressure bonding is performed on the mother laminated body by isostatic press or other suitable method, for example.

Next, using a cutting blade, the mother laminated body is cut into the laminated body laminate 12 having desired dimensions. The unfired laminated body 12 is subjected to de-binder treatment and firing.

With the above-described processes, the fired laminated body 12 is obtained. The laminated body 12 is subjected to barrel finishing to perform chamfering.

Finally, Ni plating/Sn plating is applied to the surfaces of the external electrodes 14, and the directional coupler 10*a* illustrated in FIG. 1 is completed.

In the directional coupler 10*a*, it is not necessary to discriminate a direction at the time of being mounted to the circuit substrate. In more detail, in the directional coupler 10*a*, the main line ML and the sub-line SL are plane-symmetrical or substantially plane-symmetrical with respect to the surface S2. Therefore, the distance D1 between the main line ML and the mounting surface S1 and the distance D2 between the sub-line SL and the mounting surface S1 is equal or substantially equal to each other. Thus, when the directional coupler 10*a* has been mounted to the circuit substrate, stray capacitance occurring between the main line ML and a conductor layer within the circuit substrate and stray capacitance occurring between the sub-line SL and a conductor layer within the circuit substrate are close to each other. Accordingly, the coupling characteristic, the directionality characteristic, the insertion loss, and the reflection loss of the directional coupler 10*a* when the directional coupler 10*a* is mounted to the circuit substrate so that the main line ML is used as a main line and the sub-line SL is used as a sub-line to be substantially the same as the coupling characteristic, the directionality characteristic, the insertion loss, and the reflection loss of the directional coupler 10*a* when the directional coupler 10*a* is mounted to the circuit substrate so that the main line ML is used as a sub-line and the sub-line SL is used as a main line, respectively. As a result, in the directional coupler 10*a*, it is not necessary to discriminate a direction at the time of being mounted to the circuit substrate.

Furthermore, in the directional coupler 10*a*, due to the following reason, it is also not necessary to discriminate a direction at the time of being mounted to the circuit substrate. In more detail, in the directional coupler 10*a*, the main line ML and the sub-line SL are plane-symmetrical or substantially plane-symmetrical with respect to the surface S2. Therefore, the main line ML and the sub-line SL have the same or substantially the same shape and have the same or substantially the same electrical characteristics, such as a resistance value, stray capacitance, and an inductance value. Therefore, the coupling characteristic, the directionality characteristic, the insertion loss, and the reflection loss of the directional coupler 10*a* when the directional coupler 10*a* is mounted to the circuit substrate so that the main line ML is used as a main line and the sub-line SL is used as a sub-line are the same or substantially the same as the coupling characteristic, the directionality characteristic, the insertion loss, and the reflection loss of the directional coupler 10*a* when the directional coupler 10*a* is mounted to the circuit substrate so that the main line ML is used as a sub-line and the sub-line SL is used as a main line, respectively. As a result, in the directional coupler 10*a*, it is not necessary to discriminate a direction at the time of being mounted to the circuit substrate.

In addition, since, in the directional coupler 10*a*, it is not necessary to discriminate a direction at the time of being mounted to the circuit substrate, it is not necessary to provide a direction recognition mark in the upper surface of the laminated body 12. Accordingly, stray capacitance is prevented from occurring between the main line ML or sub-line SL and the direction recognition mark since the direction recognition mark is not provided, and the coupling characteristic of the directional coupler 10*a* is prevented from deviating from a desired coupling characteristic.

In addition, in the directional coupler 10*a*, external electrodes are only provided on the side surfaces in the z direction. Therefore, parasitic capacitance occurring between the external terminal and a line is reduced, and the characteristics of the directional coupler 10*a* are improved.

Figure 4:
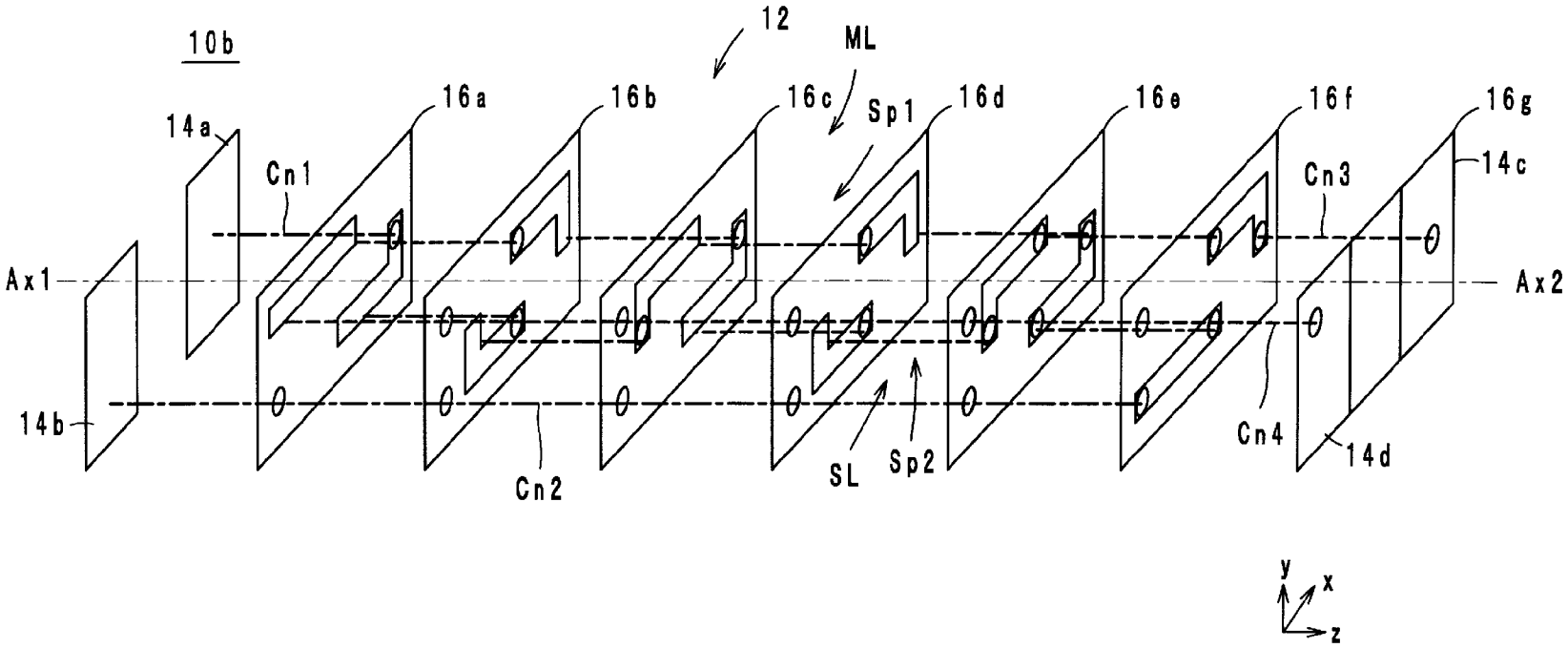
FIG. 4 is an exploded perspective view of a directional coupler according to a first example of a modification of a preferred embodiment of the present invention.

Hereinafter, a directional coupler 10*b* according to a first example of a modification of a preferred embodiment of the present invention will be described with reference to the drawings. FIG. 4 is the exploded perspective view of the directional coupler 10*b* according to the first example of a modification. In addition, as for the pattern diagram of the directional coupler 10*b*, FIGS. 3A and 3B are referred to.

In the directional coupler 10*a*, the spiral-shaped portion Sp1 and the spiral-shaped portion Sp2 overlap with each other in the z-axis direction. On the other hand, in the directional coupler 10*b*, the spiral-shaped portion Sp1 and the spiral-shaped portion Sp2 do not overlap with each other in the z-axis direction, and are aligned with one another. Accordingly, overlapping of magnetic fields occurring in the spiral-shaped portion Sp1 and the spiral-shaped portion Sp2 is increased, and it is possible to increase the degree of coupling between a main line ML and a sub-line SL. Furthermore, it is possible to shorten the length of the directional coupler 10*b* in the z-axis direction.

Figure 5:
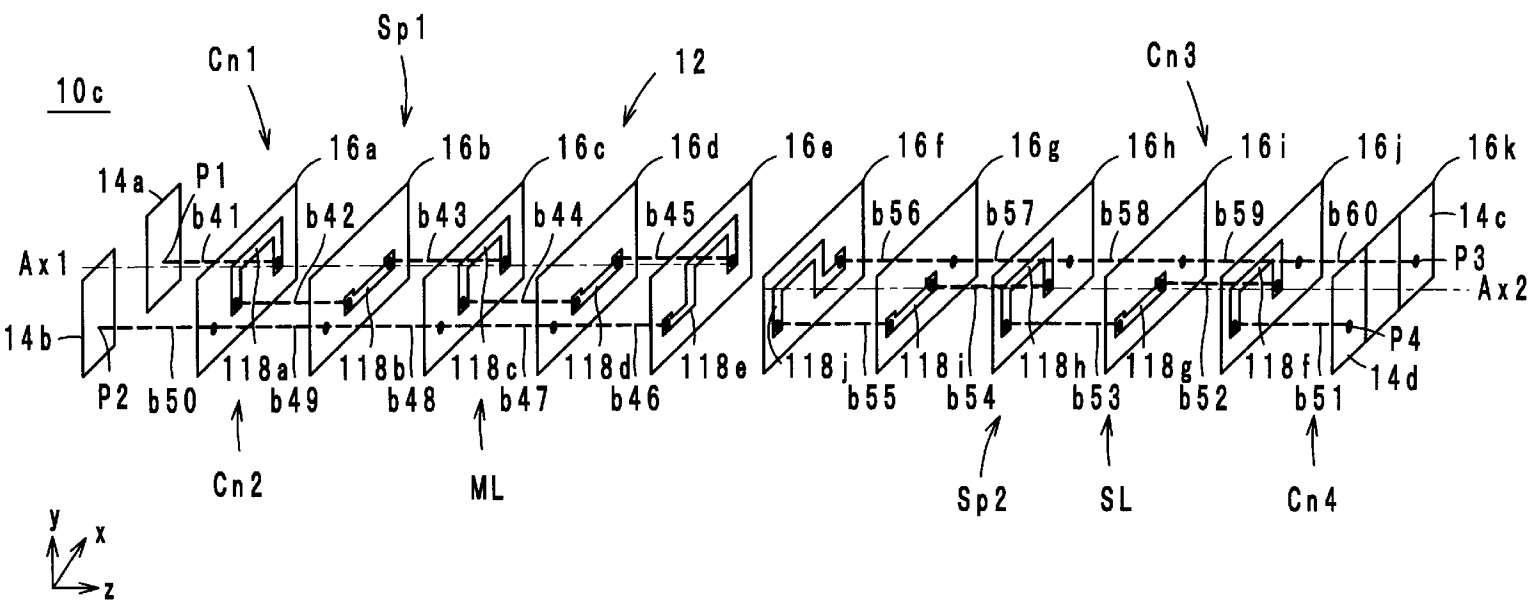
FIG. 5 is an exploded perspective view of a directional coupler according to a second example of a modification of a preferred embodiment of the present invention.

Hereinafter, a directional coupler 10*c* according to a second example of a modification of a preferred embodiment of the present invention will be described with reference to the drawings. FIG. 5 is the exploded perspective view of the directional coupler 10*c* according to the second example of a modification. FIG. 6 is a diagram schematically illustrating the directional coupler 10*c* according to the second example of a modification.

As illustrated in FIG. 1 and FIG. 5, the directional coupler 10*c* includes a laminated body 12, external electrodes 14 (14*a* to 14*d*), a main line ML, and a sub-line SL.

Since the configurations of the laminated body 12 and the external electrodes 14 in the directional coupler 10*c* are preferably the same or substantially the same as the configurations of the laminated body 12 and the external electrodes 14 in the directional coupler 10*a*, the descriptions thereof are omitted.

The main line ML is connected between the external electrodes 14*a* and 14*b*, and as illustrated in FIG. 5, includes a spiral-shaped portion Sp1 and connection portions Cn1 and Cn2. The spiral-shaped portion Sp1 is a signal line having a spiral shape extending from the negative direction side to the positive direction side in the z-axis direction while winding in a counterclockwise direction in planar view from the positive direction side in the z-axis direction. In other words, the spiral-shaped portion Sp1 has a central axis Ax1 parallel or substantially parallel to the z-axis direction. The spiral-shaped portion Sp1 is defined by signal conductors 118*a* to 118*e* and via hole conductors b42 to b45.

Each of the signal conductors 118*a* to 118*e* preferably includes a conductive material, and is defined by a linear conductor that is folded. Hereinafter, in planar view from the positive direction side in the z-axis direction, an end portion on an upstream side in the counterclockwise direction of the signal conductor 118 is referred to as an upstream end, and an end portion on an downstream side in the counterclockwise direction of the signal conductor 118 is referred to as a downstream end.

The via hole conductors b42 to b45 penetrate insulator layers 16*b* to 16*e*, respectively, in the z-axis direction, and connect the signal conductors 118. In more detail, the via hole conductor b42 connects the downstream end of the signal conductor 118*a* and the upstream end of the signal conductor 118*b*. The via hole conductor b43 connects the downstream end of the signal conductor 118*b* and the upstream end of the signal conductor 118*c*. The via hole conductor b44 connects the downstream end of the signal conductor 118*c* and the upstream end of the signal conductor 118*d*. The via hole conductor b45 connects the downstream end of the signal conductor 118*d* and the upstream end of the signal conductor 118*e*.

As illustrated in FIG. 5, the connection portion Cn1 connects an end portion (namely, the upstream end of the signal conductor 118*a*) on a negative direction side in the z-axis direction of the spiral-shaped portion Sp1 and the external electrode 14*a*, and is defined by a via hole conductor b41. The via hole conductor b41 penetrates an insulator layer 16*a* in the z-axis direction.

As illustrated in FIG. 5, the connection portion Cn2 connects an end portion (namely, the downstream end of the signal conductor 118*e*) on a positive direction side in the z-axis direction of the spiral-shaped portion Sp1 and the external electrode 14*b*, and is defined by via hole conductors b46 to b50. The via hole conductors b46 to b50 penetrate the insulator layers 16*e*, 16*d*, 16*c*, 16*b*, and 16*a*, respectively, in the z-axis direction, and by being connected to each other, define one via hole conductor. As described above, as illustrated in FIG. 6A, the main line ML is connected between the external electrodes 14*a* and 14*b*.

Figure 6A:
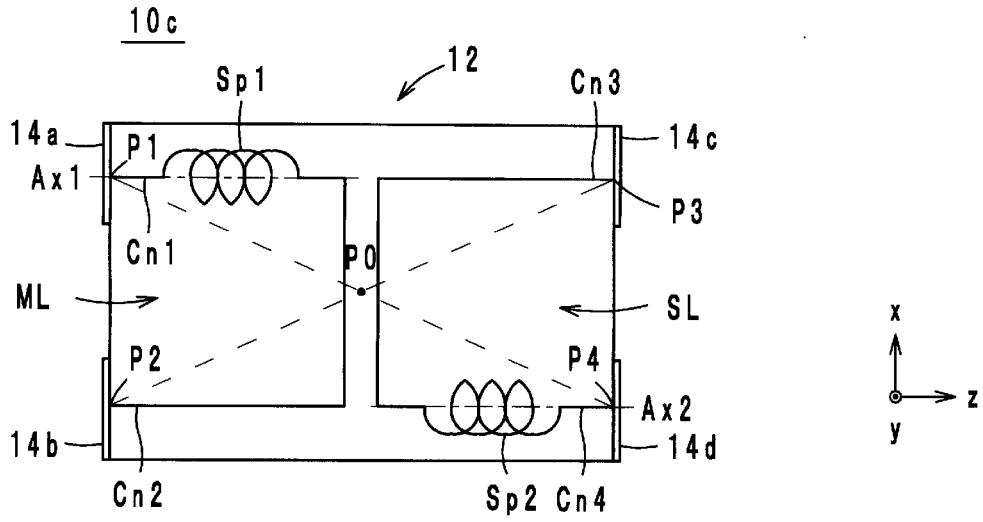
FIGS. 6A and 6B are diagrams schematically illustrating a directional coupler according to the second example of a modification of a preferred embodiment of the present invention.

The sub-line SL is connected between the external electrodes 14*c* and 14*d*. In addition, as illustrated in FIG. 6A, the sub-line SL is arranged to overlap with the main line ML when rotating by 180 degrees about a straight line extending in the y-axis direction, the straight line passing through an intersection point P0 between diagonal lines of a quadrangle defined by a connection point P1 between the external electrode 14*a* and the connection portion Cn1, a connection point P2 between the external electrode 14*b* and the connection portion Cn2, a connection point P3 between the external electrode 14*c* and a connection portion Cn3, and a connection point P4 between the external electrode 14*d* and a connection portion Cn4.

Figure 6B:
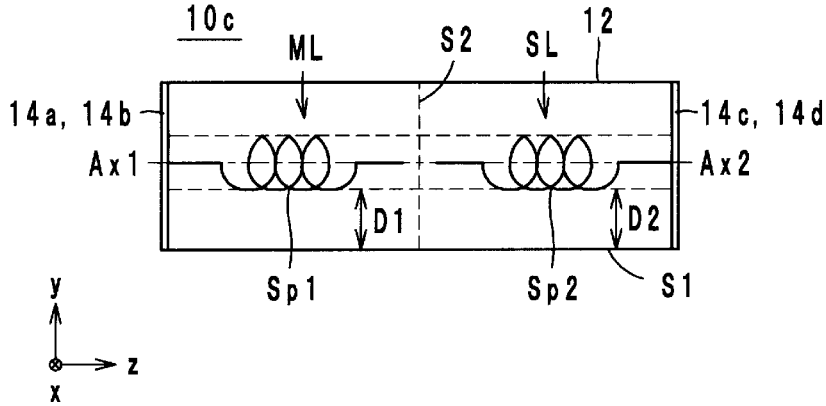

In addition, the sub-line SL defines a directional coupler by being electromagnetically coupled to the main line ML. As illustrated in FIG. 5, the sub-line SL includes a spiral-shaped portion Sp2 and the connection portions Cn3 and Cn4. The spiral-shaped portion Sp2 is a signal line having a spiral shape extending from the positive direction side to the negative direction side in the z-axis direction while winding in a clockwise direction in planar view from the positive direction side in the z-axis direction. In other words, the spiral-shaped portion Sp2 has a central axis Ax2 parallel or substantially parallel to the z-axis direction. In this regard, however, as illustrated in FIGS. 6A and 6B, while being parallel or substantially parallel to the central axis Ax1, the central axis Ax2 does not coincide with the central axis Ax1. The spiral-shaped portion Sp2 is defined by signal conductors 118*f* to 118*j* and via hole conductors b52 to b55.

Each of the signal conductors 118*f*, 118*h*, and 118*j* preferably includes a conductive material, and is defined by a linear conductor that is folded. When rotating by 180 degrees about the straight line passing through the intersection point P0 and extending in the y-axis direction, the signal conductors 118*f*, 118*h*, and 118*j* overlap with the signal conductors 118*a*, 118*c*, and 118*e*, respectively. Each of the signal conductors 118*g* and 118*i* preferably includes a conductive material, and is defined by a linear conductor that is folded. When rotating by 180 degrees about the straight line passing through the intersection point P0 and extending in the y-axis direction, the signal conductors 118*g* and 118*i* overlap with the signal conductors 118*b* and 118*d*, respectively. Hereinafter, in planar view from the positive direction side in the z-axis direction, an end portion on an upstream side in the clockwise direction of the signal conductor 118 is referred to as an upstream end and an end portion on a downstream side in the clockwise direction of the signal conductor 118 is referred to as a downstream end.

The via hole conductors b52 to b55 penetrate insulator layers 16*j*, 16*i*, 16*h*, and 16*g*, respectively, in the z-axis direction, and connect the signal conductors 118. In more detail, the via hole conductor b52 connects the downstream end of the signal conductor 118*f* and the upstream end of the signal conductor 118*g*. The via hole conductor b53 connects the downstream end of the signal conductor 118*g* and the upstream end of the signal conductor 118*h*. The via hole conductor b54 connects the downstream end of the signal conductor 118*h* and the upstream end of the signal conductor 118*i*. The via hole conductor b55 connects the downstream end of the signal conductor 118*i* and the upstream end of the signal conductor 118*j*.

In planar view from the y-axis direction, when rotating by 180 degrees about the straight line passing through the intersection point P0 and extending in the y-axis direction, the connection portion Cn3 overlaps with the connection portion Cn2. As illustrated in FIG. 5, the connection portion Cn3 connects an end portion (namely, the downstream end of the signal conductor 118*j*) on a negative direction side in the z-axis direction of the spiral-shaped portion Sp2 and the external electrode 14*c*, and is configured by via hole conductors b56 to b60. The via hole conductors b56 to b60 penetrate the insulator layers 16*g* to 16*k*, respectively, in the z-axis direction, and by being connected to each other, configure one via hole conductor.

When rotating by 180 degrees about the straight line passing through the intersection point P0 and extending in the y-axis direction, the connection portion Cn4 overlaps with the connection portion Cn1. As illustrated in FIG. 5, the connection portion Cn4 connects an end portion (namely, the upstream end of the signal conductor 118*f*) on a positive direction side in the z-axis direction of the spiral-shaped portion Sp2 and the external electrode 14*d*, and is defined by a via hole conductor b51. The via hole conductor b51 penetrates the insulator layer 16*k* in the z-axis direction. As described above, as illustrated in FIG. 6A, the sub-line SL is connected between the external electrodes 14*c* and 14*d*.

The main line ML and the sub-line SL, configured in such a manner as described above, have the same or substantially the same shape, and as illustrated in FIG. 6B, are provided within regions coinciding or substantially coinciding with each other in a perpendicular direction (y-axis direction) of the mounting surface S1. In more detail, when rotating by 180 degrees about the straight line passing through the intersection point P0 and extending in the y-axis direction, the sub-line SL overlaps with the main line ML. Therefore, as illustrated in FIG. 6B, the main line ML and the sub-line SL are disposed within regions coinciding or substantially coinciding with each other in the y-axis direction. As a result, a distance D1 between the main line ML and the mounting surface S1 and a distance D2 between the sub-line SL and the mounting surface S1 is equal or substantially equal to each other.

In the directional coupler 10*c*, when the main line ML is used as a main line and the sub-line SL is used as a sub-line, the external electrode 14*a* is used as an input port, the external electrode 14*b* is used as a main output port, the external electrode 14*c* is used as a monitor output port, and the external electrode 14*d* is used as a 50Ω terminating port, for example. On the other hand, when the main line ML is used as a sub-line and the sub-line SL is used as a main line, the external electrode 14*d* is used as an input port, the external electrode 14*c* is used as a main output port, the external electrode 14*b* is used as a monitor output port, and the external electrode 14*a* is used as a 50Ω terminating port, for example.

In the directional coupler 10*c*, in the same or substantially the same manner as the directional coupler 10*a*, it is not necessary to discriminate a direction at the time of being mounted to the circuit substrate. In addition, as illustrated in FIGS. 6A and 6B, by displacing the central axis Ax1 and the central axis Ax1 in the x-axis direction, it is possible to freely adjust the degree of coupling between the main line and the sub-line.

In addition, since, in the directional coupler 10*c*, it is not necessary to discriminate a direction at the time of being mounted to the circuit substrate, it is not necessary to provide a direction recognition mark in the upper surface of the laminated body 12.

In the directional coupler 10*c*, the connection portion Cn1, the spiral-shaped portion Sp1, and the connection portion Cn2 are connected between the external electrodes 14*a* and 14*b* in this order, and the connection portion Cn4, the spiral-shaped portion Sp2, and the connection portion Cn3 are connected between the external electrodes 14*d* and 14*c* in this order. In addition, the connection portion Cn1 and the connection portion Cn4 overlap with each other due to the rotation of 180 degrees, the spiral-shaped portion Sp1 and the spiral-shaped portion Sp2 overlap with each other due to the rotation of 180 degrees, and the connection portion Cn2 and the connection portion Cn3 overlap with each other due to the rotation of 180 degrees. Accordingly, even if rotating by 180 degrees about the straight line passing through the intersection point P0 and extending in the y-axis direction, the inner structure of the directional coupler 10*c* is substantially unchanged. Accordingly, between a case in which the main line ML is used as a main line and the sub-line SL is used as a sub-line and a case in which the main line ML is used as a sub-line and the sub-line SL is used as a main line, the electrical characteristics of the directional coupler 10*c* are substantially unchanged. Therefore, in the directional coupler 10*c*, it is also not necessary to discriminate a direction at the time of being mounted to the circuit substrate.

Figure 7:
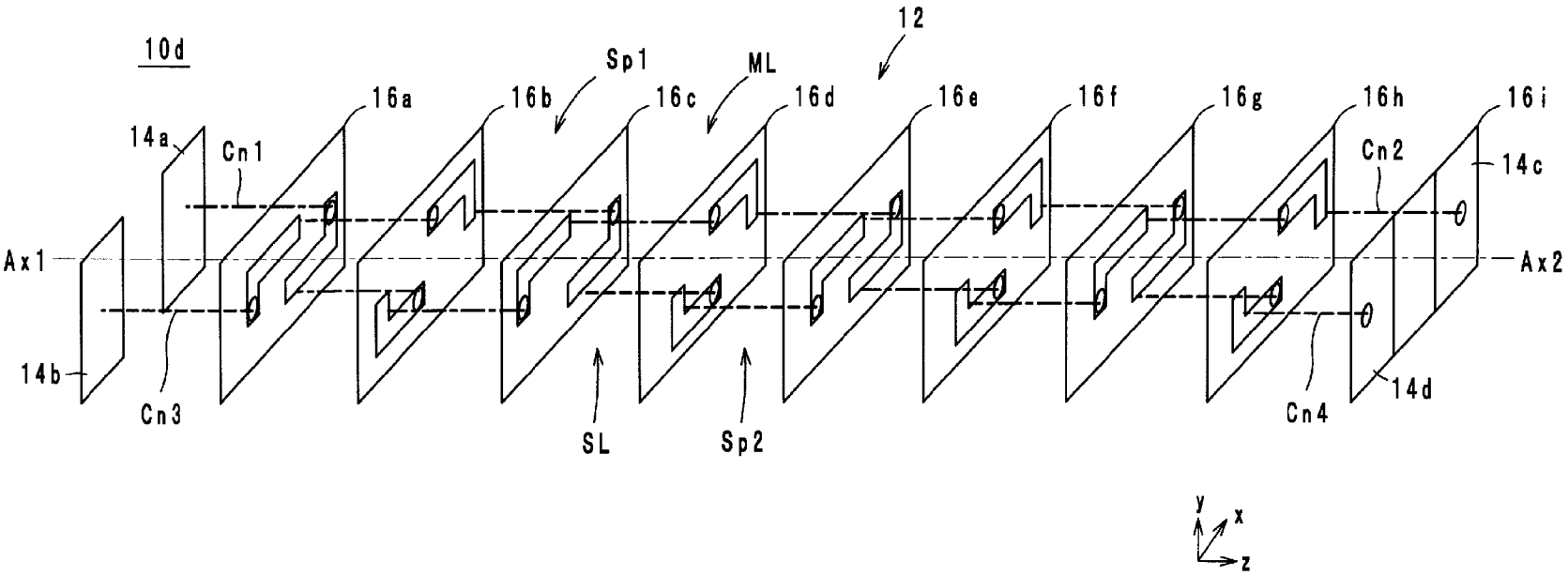
FIG. 7 is an exploded perspective view of a directional coupler according to a third example of a modification of a preferred embodiment of the present invention.
Figure 8:
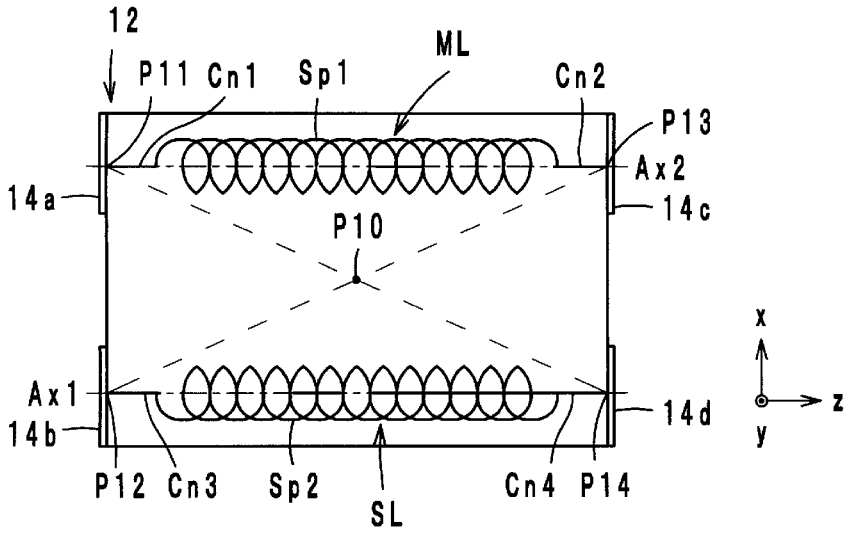
FIG. 8 is a diagram schematically illustrating a directional coupler according to the third example of a modification of a preferred embodiment of the present invention.

Hereinafter, a directional coupler 10*d* according to a third example of a modification of a preferred embodiment of the present invention will be described with reference to the drawings. FIG. 7 is the exploded perspective view of the directional coupler 10*d* according to the third example of a modification. FIG. 8 is a diagram schematically illustrating the directional coupler 10*d* according to the third example of a modification.

In the directional coupler 10*c*, the main line ML is connected between the external electrodes 14*a* and 14*b*, and the sub-line SL is connected between the external electrodes 14*c* and 14*d*. On the other hand, in the directional coupler 10*d*, the main line ML is connected between the external electrodes 14*a* and 14*c*, and the sub-line SL is connected between the external electrodes 14*b* and 14*d*. In addition, as illustrated in FIG. 7 and FIG. 8, the sub-line SL overlaps with the main line ML when rotating by 180 degrees about a straight line extending in the y-axis direction, the straight line passing through an intersection point P10 between diagonal lines of a quadrangle defined by a connection point P11 between the external electrode 14*a* and the connection portion Cn1, a connection point P12 between the external electrode 14*b* and the connection portion Cn3, a connection point P13 between the external electrode 14*c* and the connection portion Cn2, and a connection point P14 between the external electrode 14*d* and the connection portion Cn4.

In the directional coupler 10*d*, in the same or substantially the same manner as the directional coupler 10*c*, it is also not necessary to discriminate a direction at the time of being mounted to the circuit substrate. Furthermore, the spiral-shaped portion Sp1 and the spiral-shaped portion Sp2 overlap with each other in the z-axis direction. Accordingly, overlapping of magnetic fields occurring in the spiral-shaped portion Sp1 and the spiral-shaped portion Sp2 is increased, and it is possible to increase the degree of coupling between the main line ML and the sub-line SL. Furthermore, it is possible to reduce the length of the directional coupler 10*d* in the z-axis direction.

Figure 9:
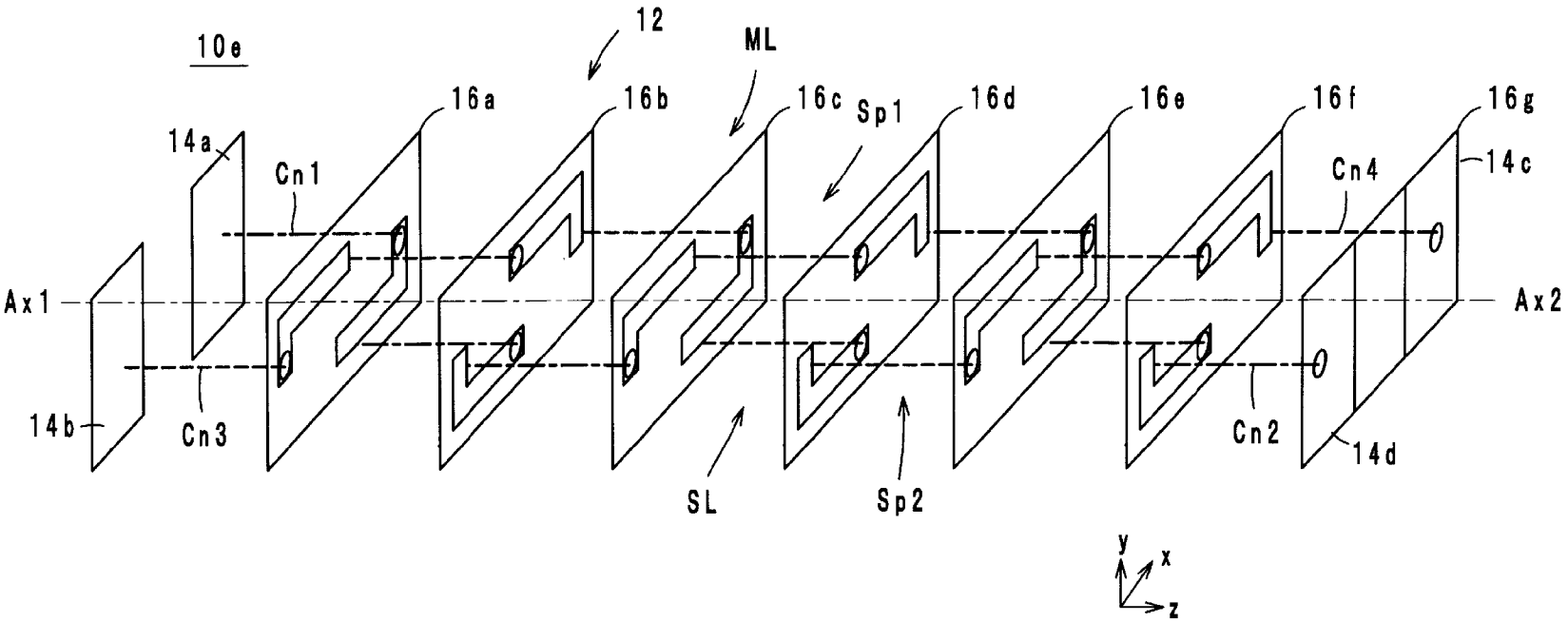
FIG. 9 is an exploded perspective view of a directional coupler according to a fourth example of a modification of a preferred embodiment of the present invention.
Figure 10:
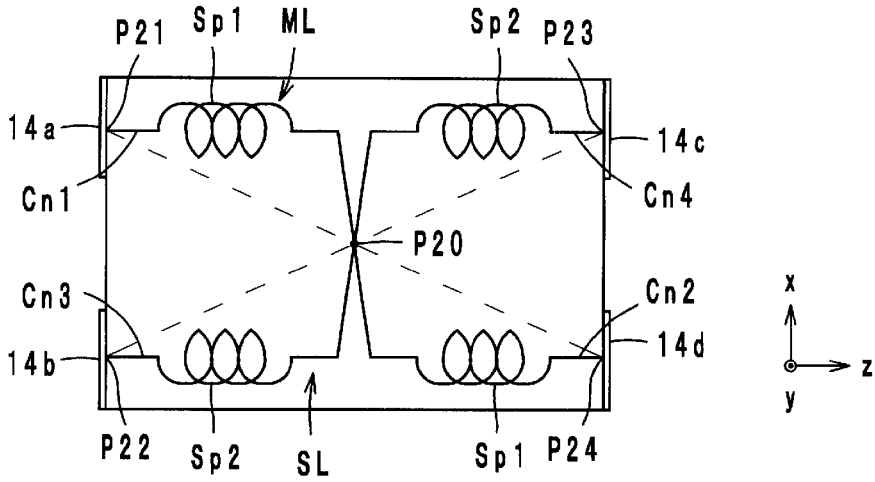
FIG. 10 is a diagram schematically illustrating a directional coupler according to the fourth example of a modification of a preferred embodiment of the present invention.
Figure 11:
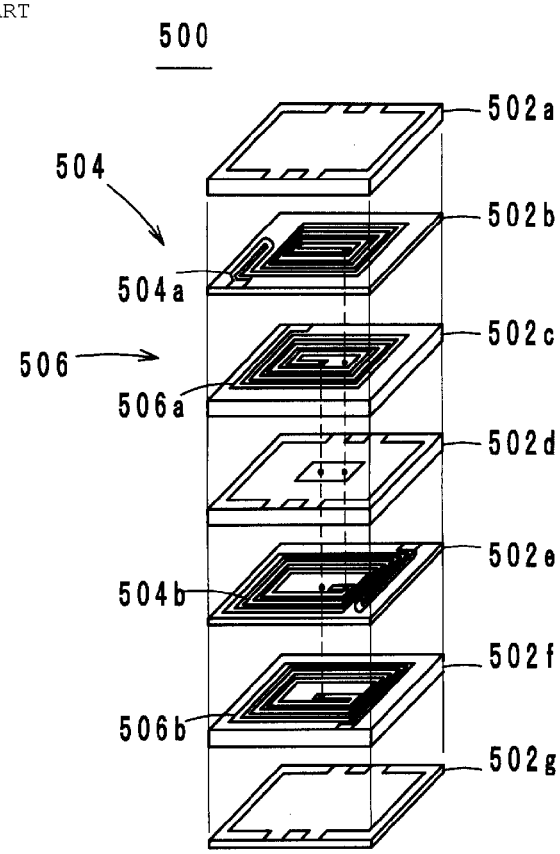
FIG. 11 PRIOR ART
FIG. 11 is an exploded view of a laminated type directional coupler described in Japanese Unexamined Patent Application Publication No. 2010-11519.

Hereinafter, a directional coupler 10*e* according to a fourth example of a modification of a preferred embodiment of the present invention will be described with reference to the drawings. FIG. 9 is the exploded perspective view of the directional coupler 10*e* according to the fourth example of a modification. FIG. 10 is a diagram schematically illustrating the directional coupler 10*e* according to the fourth example of a modification.

In the directional coupler 10*c*, the main line ML is connected between the external electrodes 14*a* and 14*b*, and the sub-line SL is connected between the external electrodes 14*c* and 14*d*. On the other hand, in the directional coupler 10*e*, the main line ML is connected between the external electrodes 14*a* and 14*d*, and the sub-line SL is connected between the external electrodes 14*b* and 14*c*. In addition, as illustrated in FIG. 9 and FIG. 10, the sub-line SL overlaps with the main line ML when rotating by 180 degrees about a straight line extending in the y-axis direction, the straight line passing through an intersection point P20 between diagonal lines of a quadrangle defined by a connection point P21 between the external electrode 14*a* and the connection portion Cn1, a connection point P22 between the external electrode 14*b* and the connection portion Cn3, a connection point P23 between the external electrode 14*c* and the connection portion Cn4, and a connection point P24 between the external electrode 14*d* and the connection portion Cn2.

In the directional coupler 10*e*, in the same or substantially the same manner as the directional coupler 10*c*, it is also not necessary to discriminate a direction at the time of being mounted to the circuit substrate, and it is also possible to increase the degree of coupling between the main line and the sub-line.

The directional couplers 10*a* to 10*e* illustrated in the above-mentioned preferred embodiments are not limited to the described configurations, and various changes may be made within the scope of the present invention.

In addition, in each of the directional couplers 10*a* to 10*e*, preferably only the main line ML and the sub-line SL are embedded in the laminated body 12. However, a configuration (for example, a ground conductor) other than the main line ML and the sub-line SL may be embedded in the laminated body 12. For example, when a ground conductor is provided in the directional coupler 10*a* illustrated in FIG. 2, it is preferable that a ground conductor is provided between the external electrodes 14*a* and 14*b* and the main line ML. In the same or substantially the same manner, it is preferable that a ground conductor is provided between the external electrodes 14*c* and 14*d* and the sub-line SL.

In this case, it is possible to freely adjust the impedance of a line due to the position of the ground conductor in the z-axis direction, and impedance matching is facilitated at the time of being mounted to the circuit substrate.

In addition, in each of the directional couplers 10*a* to 10*e*, while the connection portions Cn1 to Cn4 are embedded in the laminated body 12 and not exposed on the outside of the laminated body 12, the connection portions Cn1 to Cn4 may be exposed to the outside of the laminated body 12. In other words, the connection portions Cn1 to Cn4 may be exposed at the side surfaces of both ends in the x-axis direction.

In this case, since a range is increased in which it is possible to provide a signal conductor on an insulator layer, the degree of freedom of adjustment of the characteristic of the directional coupler is increased.

As described above, preferred embodiments of the present invention are useful for a directional coupler, and in particular, are superior in that it is not necessary to discriminate a direction at the time of being mounted to a circuit substrate.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A directional coupler comprising:

a laminated body including a plurality of insulator layers that are laminated to one another and a mounting surface parallel or substantially parallel to a lamination direction of the plurality of insulator layers; and a main line and a sub-line embedded in the laminated body, the main line including a first spiral-shaped portion and the sub-line including a second spiral-shaped portion having central axes parallel or substantially parallel to the lamination direction, and the main line and the sub-line being electromagnetically coupled to each other; wherein the main line and the sub-line have substantially the same shapes and are provided within regions coinciding or substantially coinciding with each other in a direction perpendicular or substantially perpendicular to the mounting surface;

the first spiral-shaped portion includes a plurality of first signal conductors disposed on at least two of the plurality of insulator layers;

the second spiral-shaped portion includes a plurality of second signal conductors disposed on at least two of the plurality of insulator layers; and at least a portion of the first spiral-shaped portion of the main line and at least a portion of the second spiral-shaped portion of the sub-line are disposed on at least one common insulator layer of the plurality of insulator layers.

2. The directional coupler according to claim 1, further comprising:

first, second, third and fourth external electrodes provided on a surface of the laminated body; wherein the main line further includes:

a first connection portion connecting one end of the first spiral-shaped portion and the first external electrode; and a second connection portion connecting another end of the first spiral-shaped portion and the second external electrode; and the sub-line further includes:

a third connection portion connecting one end of the second spiral-shaped portion and the third external electrode; and a fourth connection portion connecting another end of the second spiral-shaped portion and the fourth external electrode.

3. The directional coupler according to claim 2, wherein the sub-line overlaps with the main line when rotated by 180 degrees about a straight line perpendicular to the mounting surface, the straight line passing through an intersection point between diagonal lines of a quadrangle defined by a first connection point between the first external electrode and the first connection portion, a second connection point between the second external electrode and the second connection portion, a third connection point between the third external electrode and the third connection portion, and a fourth connection point between the fourth external electrode and the fourth connection portion.

4. The directional coupler according to claim 1, wherein the main line and the sub-line are plane-symmetrical or substantially plane-symmetrical with respect to a surface located midway between surfaces located in opposite ends of the laminated body in the lamination direction.

5. The directional coupler according to claim 2, wherein the first to fourth external electrodes are provided only on surfaces located in opposite ends of the laminated body in the lamination direction.

6. The directional coupler according to claim 2, further comprising:

a ground conductor provided between the first, second, third and fourth external electrodes and the first spiral-shaped portion and second spiral-shaped portion.

7. The directional coupler according to claim 1, wherein the central axis of the first spiral-shaped portion and the central axis of the second spiral-shaped portion do not coincide with each other in planar view from the lamination direction.

8. A directional coupler comprising:

a laminated body including a plurality of insulator layers that are laminated to one another and a mounting surface parallel or substantially parallel to a lamination direction of the plurality of insulator layers; and a main line and a sub-line embedded in the laminated body, and having central axes parallel or substantially parallel to the lamination direction, and the main line and the sub-line being electromagnetically coupled to each other; wherein the main line and the sub-line have substantially the same shapes and are provided within regions coinciding or substantially coinciding with each other in a direction perpendicular or substantially perpendicular to the mounting surface;

the main line includes a plurality of first signal conductors disposed on at least two of the plurality of insulator layers; and the sub-line includes a plurality of second signal conductors disposed on at least two of the plurality of insulator layers; and at least a portion of the first spiral-shaped portion of the main line and at least a portion of the second spiral-shaped portion of the sub-line are disposed on at least one common insulator layer of the plurality of insulator layers.

9. The directional coupler according to claim 8, wherein the main line includes a first spiral-shaped portion.

10. The directional coupler according to claim 8, wherein the sub-line includes a second spiral-shaped portion.

11. The directional coupler according to claim 8, wherein the main line includes a first spiral-shaped portion and the sub-line includes a second spiral-shaped portion.

12. The directional coupler according to claim 11, further comprising:

first, second, third and fourth external electrodes provided on a surface of the laminated body; wherein the main line further includes:

a first connection portion connecting one end of the first spiral-shaped portion and the first external electrode; and a second connection portion connecting another end of the first spiral-shaped portion and the second external electrode; and the sub-line further includes:

a third connection portion connecting one end of the second spiral-shaped portion and the third external electrode; and a fourth connection portion connecting another end of the second spiral-shaped portion and the fourth external electrode.

13. The directional coupler according to claim 8, wherein the sub-line overlaps with the main line when rotated by 180 degrees about a straight line perpendicular to the mounting surface, the straight line passing through an intersection point between diagonal lines of a quadrangle defined by a first connection point between the first external electrode and the first connection portion, a second connection point between the second external electrode and the second connection portion, a third connection point between the third external electrode and the third connection portion, and a fourth connection point between the fourth external electrode and the fourth connection portion.

14. The directional coupler according to claim 8, wherein the main line and the sub-line are plane-symmetrical or substantially plane-symmetrical with respect to a surface located midway between surfaces located in opposite ends of the laminated body in the lamination direction.

15. The directional coupler according to claim 12, wherein the first, second, third and fourth external electrodes are provided only on surfaces located in opposite ends of the laminated body in the lamination direction.

16. The directional coupler according to claim 12, further comprising a ground conductor provided between the first, second, third and fourth external electrodes and the first spiral-shaped portion and the second spiral-shaped portion.

17. The directional coupler according to claim 11, wherein the central axis of the first spiral-shaped portion and the central axis of the second spiral-shaped portion do not coincide with each other in planar view from the lamination direction.

* * * * *